US009216867B2

(12) United States Patent
Aoyama

(10) Patent No.: US 9,216,867 B2
(45) Date of Patent: Dec. 22, 2015

(54) SHEET FEEDER AND IMAGE FORMING APPARATUS INCORPORATING SAME

(71) Applicant: Jumpei Aoyama, Kanagawa (JP)

(72) Inventor: Jumpei Aoyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 9 days.

(21) Appl. No.: 14/151,941

(22) Filed: Jan. 10, 2014

(65) Prior Publication Data

US 2014/0210157 A1 Jul. 31, 2014

(30) Foreign Application Priority Data

Jan. 29, 2013 (JP) ..... 2013-014341

(51) Int. Cl.
*B65H 1/08* (2006.01)
*B65H 1/04* (2006.01)

(52) U.S. Cl.
CPC ..... *B65H 1/04* (2013.01); *B65H 2301/36212* (2013.01); *B65H 2301/4222* (2013.01); *B65H 2403/411* (2013.01); *B65H 2403/531* (2013.01); *B65H 2403/60* (2013.01); *B65H 2405/1144* (2013.01); *B65H 2405/324* (2013.01); *B65H 2407/21* (2013.01); *B65H 2511/12* (2013.01); *B65H 2511/22* (2013.01); *B65H 2801/06* (2013.01)

(58) Field of Classification Search
CPC ..... B65H 2301/36212; B65H 2301/4222; B65H 2303/60; B65H 2701/113; B65H 2701/1131
USPC ..... 271/162, 171
See application file for complete search history.

(56) References Cited

U.S. PATENT DOCUMENTS

| | | | | |
|---|---|---|---|---|
| 6,581,924 | B2 * | 6/2003 | Gaarder et al. | 271/114 |
| 7,416,181 | B2 * | 8/2008 | Murakami et al. | 271/162 |
| 7,429,041 | B2 * | 9/2008 | Yokoi | 271/162 |
| 7,618,038 | B2 * | 11/2009 | Aida | 271/162 |
| 2003/0178764 | A1 * | 9/2003 | Hasegawa | 271/171 |

FOREIGN PATENT DOCUMENTS

| | | |
|---|---|---|
| JP | 2007-050972 | 3/2007 |
| JP | 2008-094528 | 4/2008 |
| JP | 2009-167005 | 7/2009 |

* cited by examiner

*Primary Examiner* — Howard Sanders
(74) *Attorney, Agent, or Firm* — Harness, Dickey & Pierce, P.L.C.

(57) ABSTRACT

A sheet feeder, which is included in an image forming apparatus, includes a sheet tray on which a recording medium is loaded, a regulating member, a link mechanism, and a guide storage. The regulating member is movably disposed to regulate a position of the recording medium loaded on the sheet tray and has guide portions having a height higher than a maximum possible thickness of a sheet stack loadable on the sheet tray and the height thereof is changeable. The link mechanism rotatably supports the sheet tray with respect to a tray storing position and a sheet feeding position. The guide storage stores the guide portions of the regulating member as the link mechanism moves the sheet tray from the sheet feeding position to the tray storing position and has a depth set to be greater than a length in a height direction of the guide portions.

11 Claims, 10 Drawing Sheets

SHEET FEEDER AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2013-014341, filed on Jan. 29, 2013 in the Japan Patent Office, the entire disclosure of which is hereby incorporated by reference herein.

BACKGROUND

1. Technical Field

Embodiments of the present invention relate to a sheet feeder such as a manual sheet feeder and an image forming apparatus that includes the sheet feeder.

2. Related Art

Image forming apparatuses generally include a manual sheet feeder that feeds a recording medium from outside the apparatus. Equipping the manual sheet feeder, the image forming apparatus can produce copies on special sheets such as OHP (overhead projector) films or perform interrupt copy processing.

The manual sheet feeder of the image forming apparatus typically includes a bypass tray that is openably closed with respect to a manual sheet feeding port located on a side surface of the image forming apparatus. The bypass tray is generally closed to become a part of the outer surface of the image forming apparatus. In a manual feeding operation, a user opens the bypass tray with a given angle with respect to the side surface of the image forming apparatus. Examples of the configuration are disclosed in Japanese Patent Application Publication Nos. JP 2008-094528-A, JP 2007-050972-A (JP 4764676-B), and JP 2009-167005.

However, JP 2008-094528-A discloses the configuration in which a bypass tray is openably closed to cover the manual feeding port to minimize the entire height of the image forming apparatus. Therefore, it is difficult to reduce the size of the bypass tray by the height of a side guide. Consequently, the configuration is believed not to appropriate for space saving.

The side guide is a paper guide to align a paper width that is a position in a direction perpendicular to a sheet feeding direction of a sheet or sheets loaded on the bypass tray. The side guide prevents zigzag and skew of the sheet(s) in the sheet feeding. Therefore, the side is generally formed to be higher than the maximum possible thickness of a sheet stack that can be loaded on the bypass tray. That is, the number of sheets that can be loaded on the bypass tray at one time is limited by the height of the side guide.

By contrast, JP 2007-050972-A discloses the configuration in which an outer surface of the bypass tray is stored as a substantially same surface as an outer surface of the duplex unit, and the bypass tray opens and closes the bypass tray via a link mechanism so that a sheet loading surface of the bypass tray, which is an inner surface of the bypass tray, is connected to the manual sheet feeding port in the copying operation. Consequently, even if the configuration is applicable to space saving, the bypass tray is stored in the side surface of the duplex unit while moving the bypass tray in the vertical direction. Therefore, in a case in which the height of the side fence disclosed in JP 2007-050972-A, which corresponds to the side fence disclosed in JP 2008-094528-A, is secured, the size of the duplex unit increases.

Further, JP2009-167005 discloses a configuration that can reduce the installation space. However, a sufficient space is required to provide an auxiliary fence (auxiliary fences) immediately before a registration roller pair disposed at a downward side in a sheet conveying direction. Therefore, if the space is not secured, it tends to be difficult to locate the auxiliary fence(s) due to the layout restrictions.

SUMMARY

At least one embodiment of the present invention provides a sheet feeder including a sheet tray on which a recording medium is loaded, a regulating member movably disposed to regulate a position of the recording medium loaded on the sheet tray and having guide portions having a height higher than a maximum possible thickness of a sheet stack load able on the sheet tray and the height thereof is changeable, a link mechanism to rotatably support the sheet tray with respect to a tray storing position and a sheet feeding position, and a guide storage to store the guide portions of the regulating member as the link mechanism moves the sheet tray from the sheet feeding position to the tray storing position and having a depth set to be greater than a length in a height direction of the guide portions.

Further, at least one embodiment of the present invention provides an image forming apparatus including the above-described sheet feeder.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein:

FIG. 11A is a cross-sectional view illustrating a state in which the sheet tray is stored, and FIG. 11B is a cross-sectional view illustrating a state in which the sheet tray is feeding the sheet.

DETAILED DESCRIPTION

Figure 1:
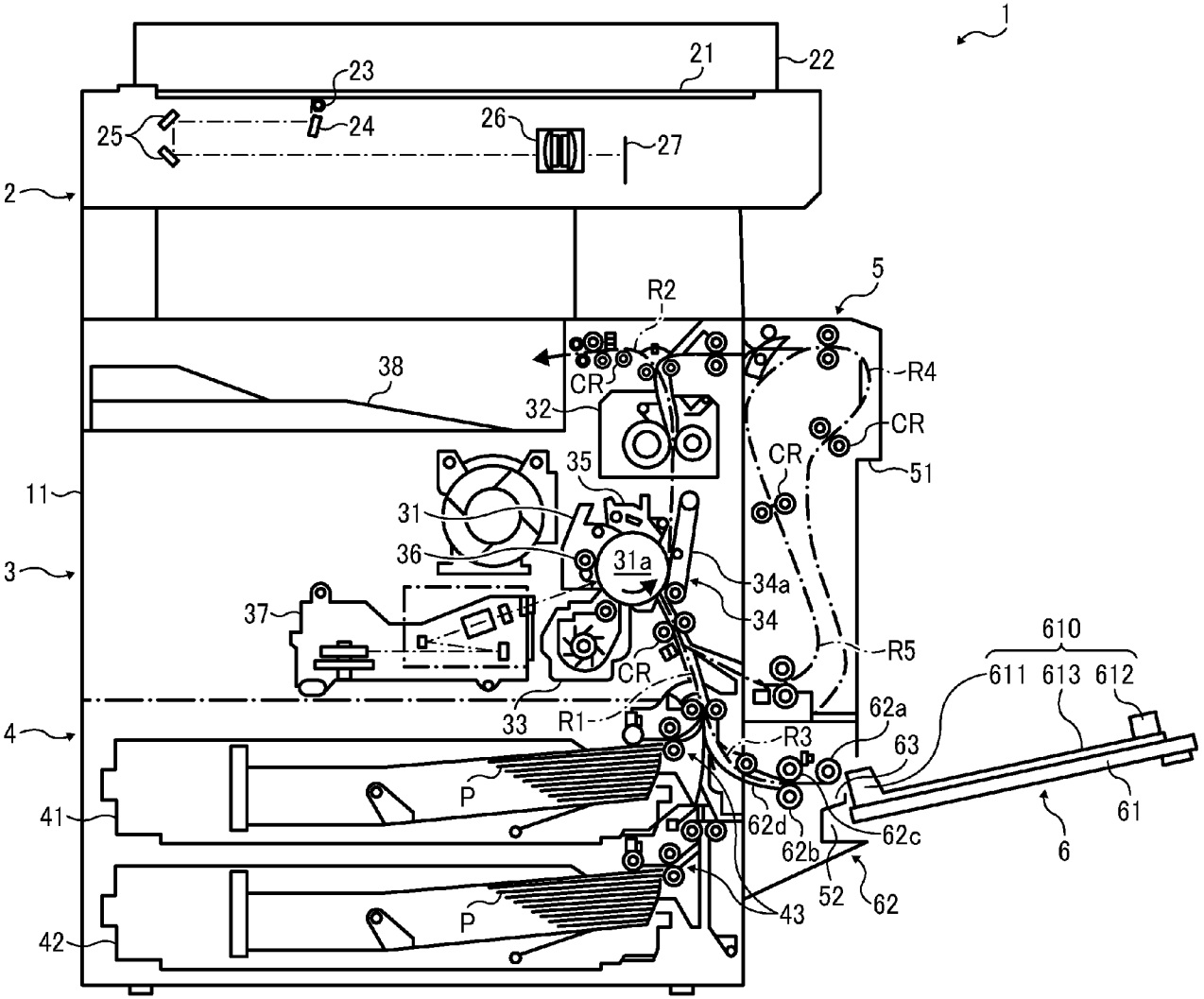
FIG. 1 is a cross-sectional view illustrating a schematic configuration of an image forming apparatus incorporating a manual sheet feeder according to an embodiment of the present invention.

It will be understood that if an element or layer is referred to as being "on", "against", "connected to" or "coupled to"

another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

A description is given of an image forming apparatus 1 according to an embodiment of the present invention, with reference to FIG. 1.

FIG. 1 is a cross-sectional view illustrating a schematic configuration of the image forming apparatus 1 incorporating a manual sheet feeder 6 that functions as a sheet feeder according to an embodiment.

FIG. 1 is a vertical cross sectional view illustrating a schematic configuration of an image forming apparatus 1 according to an embodiment of the present invention. The image forming apparatus 1 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 1 is an electrophotographic color printer that forms color and monochrome toner images on recording media by electrophotography.

As illustrated in FIG. 1, the image forming apparatus 1 includes an image reading part 2, an image forming part 3, a sheet feeding part 4, a duplex unit 5, and a manual sheet feeder 6.

The image reading part 2 is located at an upper part of the apparatus body 11 of the image forming apparatus 1 and includes a contact glass 21, a document pressing plate 22, and optical units. The document pressing plate 22 presses an original document placed at an image reading position on the contact glass 21. The optical units read an image formed on the original image at the image reading position on the contact glass 21.

The optical units optically read the image on the original document from below the contact glass 21 in a given scanning range of the original document that corresponds to the image reading position. Examples of the optical units are a lamp 23, mirrors 24 and 25, an image forming lens 26, and an image reading sensor (image capturing sensor) 27. The lamp 23 and the mirror 24 are provided to a first carriage and the mirror 25 is provided to a second carriage.

During a copy operation, as the first carriage and the second carriage moves below the contact glass 21 at a given speed in a given direction, the image reading part 2 causes the lamp 23 of the first carriage to emit light beams on the original document set on the contact glass 21. Then, the mirror 24 of the first carriage and the mirror 25 of the second carriage reflect and bend the light beams, and the image forming lens 26 causes the light beams to form an image on the reading sensor 27. Thus, by forming an image on the reading sensor 27 by the light beams reflected on the original document, the image of the original document is optically read by the optical units.

Both length and width of the document pressing plate 22 are secured to be greater than those of the contact glass 21. One end of the document pressing plate 22, e.g., a rear side of the apparatus body 11, is connected to an upper surface of the apparatus body 11 with hinges. Specifically, the document pressing plate 22 is disposed to be openably closed with respect to the contact glass 21. The document pressing plate 22 can be closed when pressing and fixing the original document on to the contact glass 21. The document pressing plate 22 can be opened when the original document is set on or removed from the contact glass 21.

Thus, the document pressing plate 22 of the image reading part 2 can be switched between a horizontal state in which the document pressing plate 22 covers the upper surface of the contact glass 21 and a vertical state in which the document pressing plate 22 is separated from the upper surface of the contact glass 21.

It is to be noted that the original document is not limited to a single sheet-like paper. For example, a book or a paper stack having a certain thickness is applicable.

The image forming part 3 includes a photoconductor unit 31, a fixing unit 32, a development unit 33, a transfer unit 34, a photoconductor cleaning unit 35, a discharging and charging unit 36, and an exposure unit 37.

The image forming part 3 is disposed at a middle step of the apparatus body 11 below the image reading part 2 and has a given space with respect to the image reading part 2.

During the copying operation, the image forming part 3 performs a cleaning operation by the photoconductor cleaning unit 35 with respect to a surface of the photoconductor drum 31*a* of the photoconductor unit 31 and an electric discharging operation and a charging operation by the discharging and charging unit 36. After the charging operation, the exposure unit 37 of the image forming part 3 optically exposes the surface of the photoconductor drum 31*a* to form an electrostatic latent image on the surface of the photoconductor drum 31*a* based on image data read by the reading sensor 27 of the image reading part 2. Then, the development unit 33 of the image forming part 3 supplies toner to the photoconductor drum 31*a*, so that an electrostatic latent image is developed.

Further, at the copy position, the image forming part 3 causes a transfer belt 34*a* of the transfer unit 34 to transfer a developed toner image formed on the photoconductor drum 31*a* onto a recording sheet P that is conveyed from the sheet feeding part 4 or the manual sheet feeder 6. Thereafter, in the image forming part 3, toner on the toner image transferred onto the recording sheet P is melt in the fixing unit 32, so that a copy image of the image of the original document is fixed to the recording medium.

The image forming part 3 has an upper surface on which a sheet discharging tray 38 is disposed to discharge the recording sheet P after the copy operation the image of the original document. The recording sheet P discharged to the sheet discharging tray 38 is collected by a user from a given hollow space provided between the image reading part 2 and the image forming part 3.

The image forming part 3 includes conveying paths R1 and R2, and multiple conveying rollers CR. The conveying paths R1 and R2 convey the recording sheet P into the apparatus body 11. The conveying path R1 is a path to convey the recording sheet P before the copy operation to a copy position. The conveying path R2 is a path to convey the recording sheet P after the copy operation to the sheet discharging tray 38. Each of the multiple conveying rollers CR are disposed at appropriate positions in the conveying paths R1 and R2 at given intervals corresponding to the recording sheet P having a minimum size.

The sheet feeding part 4 is disposed at a lower portion of the apparatus body 11 below the image forming part 3 and includes sheet trays 41 and 42 to store recording sheets including a recording sheet P to be fed to the image forming part 3. The sheet feeding part 4 further includes a sheet feeder 43 to take the recording sheet P from one of sheet trays 41 and 42 and guide the recording sheet P to the conveying path R1.

The sheet trays 41 and 42 are, for example, vertically disposed to be pulled out to a front side (an operator standing side) of the apparatus body 11 of the image forming apparatus 1. The recording sheet P is loaded with either of the sheet trays 41 and 42 pulled out from the apparatus body 11. The sheet trays 41 and 42 can contain multiple recording sheets P of the same size or different size from each other as a stack of recording sheets P.

The sheet feeder 43 is provided to each of the sheet trays 41 and 42. The sheet feeder 43 includes a pickup roller, a separation/conveyance roller pair, a conveyance roller, and a sheet conveying path. The pickup roller picks up an uppermost recording sheet P placed on top of the stack of recording sheets contained in the sheet trays 41 and 42. The separation/conveyance roller pair separates the uppermost recording sheet P picked up by the pickup roller from other recording sheets P of the stack of recording sheets P, and feed the picked-up roller forward the recording sheet P one by one.

The sheet trays 41 and 42 and the sheet feeder 43 of the sheet feeding part 4 are selectively determined according to the size of the target original document to be read automatically or by a manual setting by the operator along with the copying operation.

That is, the image forming apparatus 1 according to the present embodiment employs a front loading type in which the recording sheet P is fed from one of the sheet trays 41 and 42 with the sheet trays 41 and 42 set to the sheet feeding part 4.

It is to be noted that, as an example of the recording sheet P that can be stored in the sheet trays 41 and 42, PPC papers and OHP (overhead projector) films can be applied.

At an upper right portion of the sheet feeding part 4, that is, at one side surface of the sheet feeding part 4, a guidance path R3 is provided to guide the recording sheet P fed by the manual sheet feeder 6 to the conveying path R1 of the image forming part 3.

The duplex unit 5 is provided, for example, at a right side surface of the apparatus body 11 to face the image forming part 3. In a duplex copying operation or an operation to copy or print the image of the original document to both side of the recording sheet P, the duplex unit 5 reverses the sides of the recording sheet P with an image of the original document printed on a front surface thereof and feeds the recording sheet P again to the copying position of the image forming part 3.

The duplex unit 5 includes a switchback path R4, a reentry path R5, and the multiple conveying rollers CR.

That is, the duplex unit 5 conveys the recording sheet P to the switchback path R4, then to the image forming part 3 via the reentry path R5, and to the conveying path R1 again without conveying the recording sheet P in the conveyance path R2 toward the sheet discharging tray 38. By so doing, an image of the original document is printed on the reverse side of the recording sheet P. Consequently, both sides of the recording sheet P have the images of the original document. Thus, the duplex copy operation is performed.

The manual sheet feeder 6 is disposed facing an exterior of the duplex unit 5 at a lower portion of the duplex unit 5 and below the switchback path R4.

The manual sheet feeder 6 includes a sheet tray 61 that functions as a bypass table on which multiple recording sheets P can be loaded. Further, a bypass slot 63 is provided to the duplex unit 5. The manual sheet feeder 6 is attached to the bypass slot 63 that includes a sheet feeding mechanism 62 to guide the recording sheet P loaded on the sheet tray 61 to the guidance path R3 of the sheet feeding part 4.

The sheet feeding mechanism 62 includes a pickup roller 62*a*, separation/conveyance rollers 62*b* and 62*c*, and a conveying path 62*d*. The pickup roller 62*a* picks up the uppermost recording sheet P placed on top of the multiple recording sheets on the sheet tray 61. The separation/conveyance rollers 62*b* and 62*c* separate the uppermost recording sheet P picked up by the pickup roller 62*a* and feed the uppermost recording sheet P one by one. The conveying path 62*d* leads to the guidance path R3.

The pickup roller 62*a* is disposed vertically movable so as to constantly contact the uppermost recording sheet P on the sheet tray 61. Specifically, the pickup roller 62*a* can change the height of the recording sheet P on the sheet tray 61 along with the sheet feeding operation of the recording sheet P. That is, the pickup roller 62*a* can change the position of the sheet tray 61 as the thickness of the stack of recording sheets changes.

The separation/conveyance rollers 62*b* and 62*c* includes a reverse roller 62*b* and a feed roller 62*c* with the conveying path 62*d* interposed therebetween to prevent multi-feeding of the recording sheets P. For example, when two recording sheets P are picked up simultaneously by the pickup roller 62*a*, one recording sheet P close to the reverse roller 62*b* is pulled back in a direction toward the sheet tray 61 as the reverse roller 62*b* rotates. By contrast, the other recording sheet P close to the feed roller 62*c* is fed in a direction toward the conveying path 62*d* as the feed roller 62*c* rotates.

In the present embodiment, the direction toward the conveying path 62*d* is a sheet feeding direction and the direction toward the sheet tray 61 is an opposite direction to the sheet feeding direction.

The sheet tray 61 is supported by a link mechanism to be rotatable between a tray storing position and a sheet feeding position. Specifically, the sheet tray 61 is stored in the tray storage 51 that is a tray storing position during a normal copying operation and is rotated to the sheet feeding position facing the bypass slot 63 during a bypass feeding operation.

It is to be noted that the image forming apparatus 1 has an operation display unit. For example, the operation display unit includes an input key used to operate during the copying operation by an operator and a liquid crystal panel displaying the operation guidance and the touch-type input key.

By preparing a key to set a bypass feeding mode as an input key on the operation display unit, the copying operation to the recording sheet P fed by the manual sheet feeder 6 is selectable due to manual settings by the operator.

Figure 2:
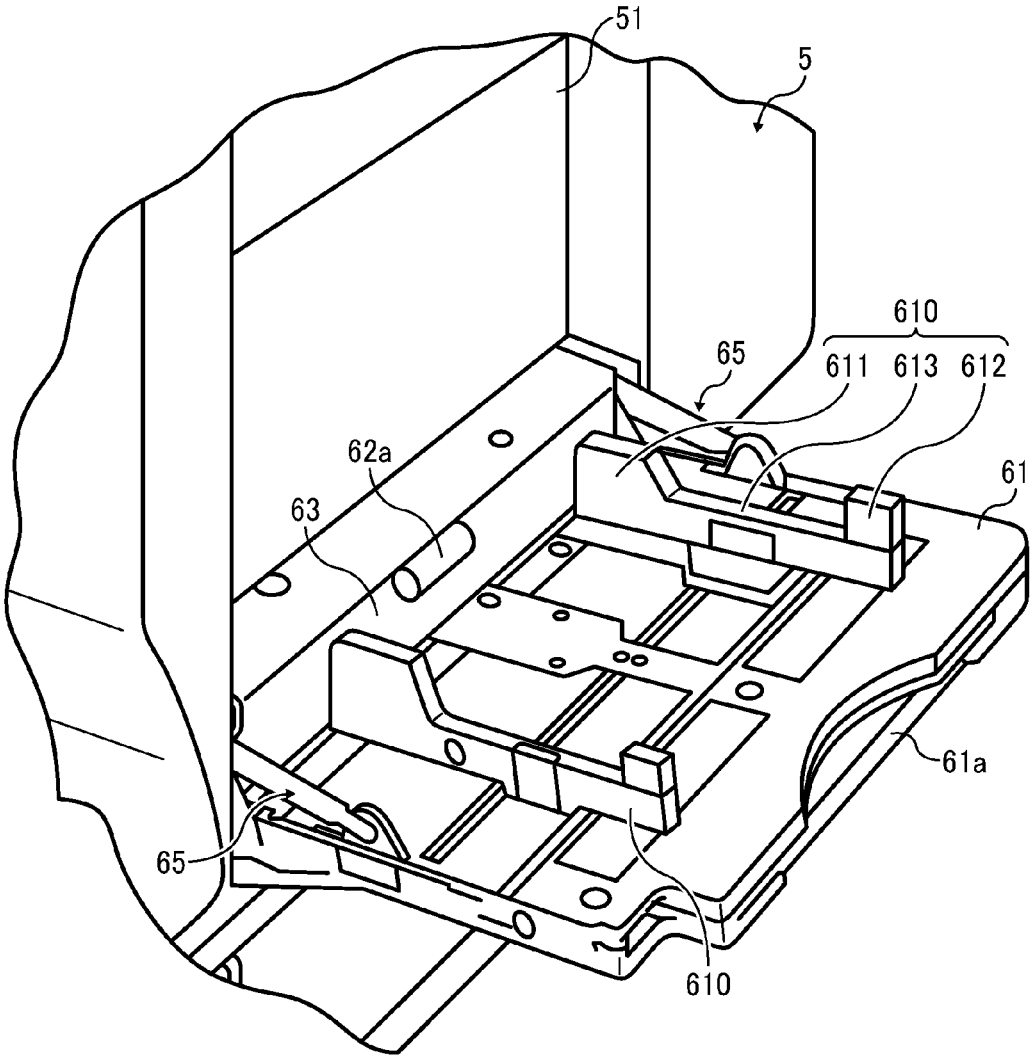
FIG. 2 is a perspective view illustrating a sheet tray included in the manual sheet feeder according to an embodiment.

FIG. 2 is a diagram illustrating enlargement of the manual sheet feeder 6 at the sheet feeding position.

As illustrated in FIG. 2, the sheet tray 61 of the manual sheet feeder 6 includes an extension tray 61*a* that can pulled out in the opposite direction when the sheet tray 61 is moved from the tray storing position to the sheet feeding position. The extension tray 61*a* assists the loading and placing of the recording sheet P having a large size greater than the A4 size.

The sheet tray 61 has a bottom plate serving as a sheet loading surface. A pair of side fences (side guides) 610 that functions as a regulating member are provided to the bottom plate manually or automatically. The pair of side fences 610 regulates a length of the recording sheet P on the sheet tray 61 in a direction perpendicular to the sheet feeding direction that is the width direction of the recording sheet P according to a position at which the pair of side fences 610 slide. The stack of the recording sheets P is jogged and aligned in the vertical direction as the leading edge in the width direction of the recording sheet P contacts the pair of side fences 610.

Further, the pair of side fences 610 includes guides 611 and 612. Each of the guides 611 and 612 has a one end and the other end that is opposite to the one end. The guides 611 and 612 are disposed to prevent the recording sheet P in the sheet feeding operation from moving in a zigzag manner or in a slant manner when the reading sheet P is fed.

In the present embodiment, the one end of the pair of side fences 610 is the leading edge of the recording sheet P to the sheet feeding direction and the other end of the pair of side fences 610 is the trailing edge of the recording sheet P. Further, another portion of the pair of side fences 610 suggests a middle portion 613 between the one end and the other end.

Specifically, the guides 611 and 612 of the pair of side fences 610 are set so that the heights of the guides 611 and 612 are higher than the maximum height of a stack of recording sheets P that can be placed as the stack of recording sheets P. By so doing, the entire recording sheets P placed on the sheet tray 61 can prevent a zigzag manner and a slanted beach with respect to the recording sheet P.

The guide 611 of the pair of side fences 610 is integrally formed with the middle portion 613. The guide 611 is formed to be constantly in an upright state, which is the first state, regardless of the tray storing position and the sheet feeding position.

The guide 612 is supported by a hinge to be foldable between the first state in which the guide 612 stands upright at the sheet feeding position and the second state in which the guide 612 is bent at the tray storing position. Specifically, the guide 612 is moved from the second state to the first state when the sheet tray 61 is shifted from the tray storing position to the sheet feeding position and is moved from the first state to the second state when sheet tray 61 is shifted from the sheet feeding position to the tray storing position.

In the present embodiment, the pair of side fences 610 employs a center alignment type that aligns the recording sheet P at a substantially center position of the sheet tray 61. With the pair of side fences 610 of the center alignment type, a conveying force can be distributed symmetrically with respect to the recording sheet P of any size that can be loaded on the sheet tray 61.

It is to be noted that, other than the center alignment type, the pair of side fences 610 can employ a side alignment type that aligns the recording sheet P at one side by a single slidable side fence.

A four-bar linkage 65 is a link to rotate the sheet tray 61. Details of the four-bar linkage 65 will be described below.

Figure 3:
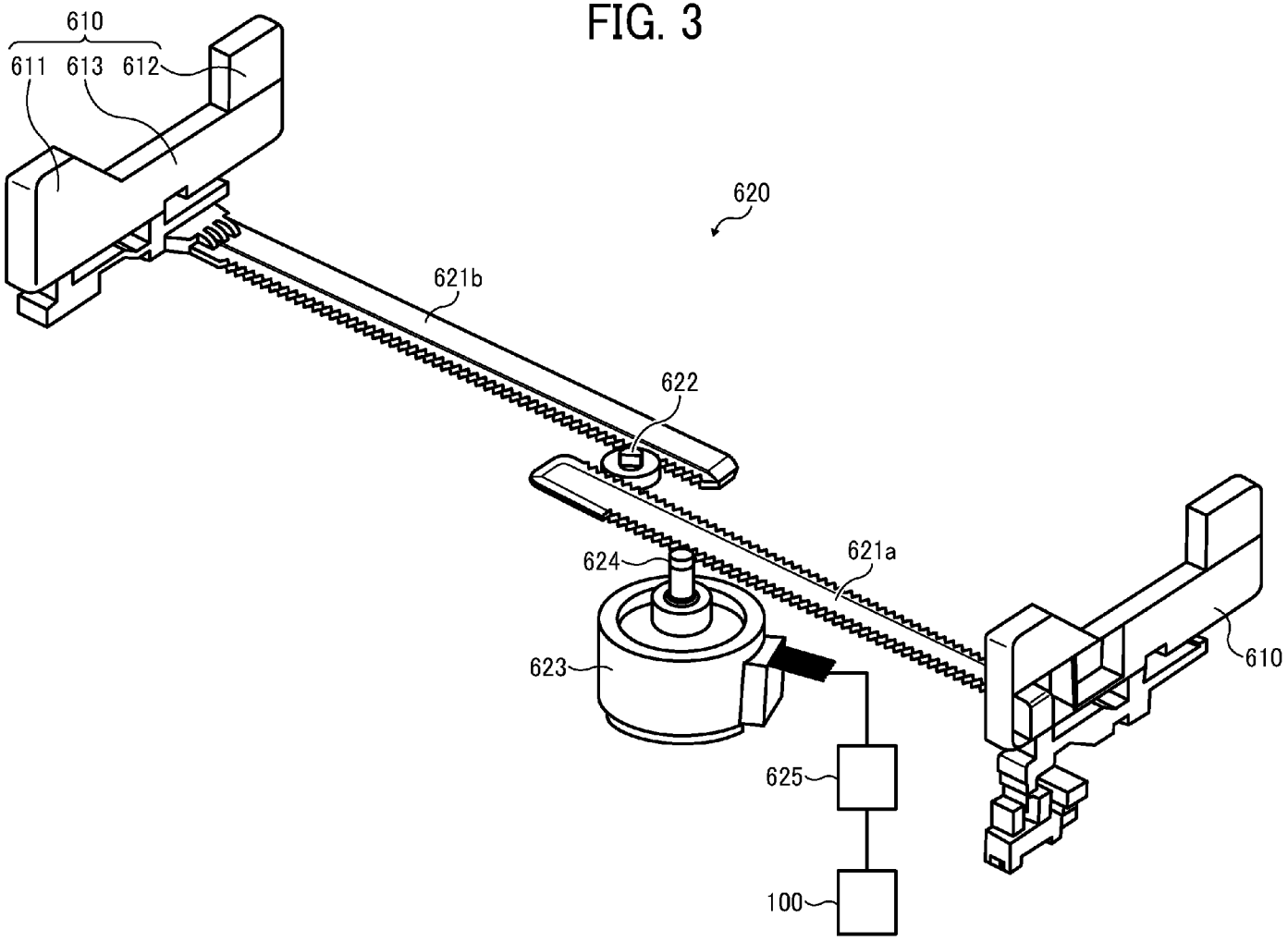
FIG. 3 is an exploded perspective view illustrating a drive mechanism of a side fence of the manual sheet feeder according to an embodiment.

FIG. 3 is a diagram illustrating a configuration of a side fence drive mechanism 620 that can slide the pair of side fences 610 automatically. The side fence drive mechanism 620 is provided inside the sheet tray 61. For example, the side fence drive mechanism 620 employs a rack and pinion mechanism including rack gears 621*a* and 621*b*, a connecting pinion gear 622, and a drive motor 623. The rack gears 621 are attached to the respective fences of the pair of side fences 610. The connecting pinion gear 622 is meshed with the respective rack gears 621*a* and 621*b*.

In the side fence drive mechanism 620, a drive pinion gear 624 that is attached to a shaft of the drive motor 623 is engaged with a first rack gear 621*a*, so that a driving force applied by the drive motor 623 is transmitted to the first rack gear 621*a* via the drive pinion gear 624. The drive force transmitted to the first rack gear 621*a* is further transmitted to a second rack gear 621*b* via the connecting pinion gear 622. Consequently, by the operation of the side fence drive mechanism 620, the respective fences of the pair of side fences 610 are shifted in a direction to move close to each other or a direction to move away from each other symmetrically by the same amount.

Further, the side fence drive mechanism 620 causes the pair of side fences 610 to move and contact the recording sheet P loaded on the sheet tray 61 to stop the movement of the pair of side fences 610, so that the position in the width direction of the recording sheet P is regulated.

It is to be noted that a DC motor (a direct current motor) can be used as the drive motor 623. The DC motor is a motor driving with a direct current power source and has a large starting torque, linear rotation characteristics to voltage variation, linearity of output torque to an input current, and high power efficiency, and therefore has a sufficiently high rotation characteristics as a control motor.

Further, the drive motor 623 is further connected to a load current detector 625 that detects a current value that flows in the drive motor 623.

Figure 4:
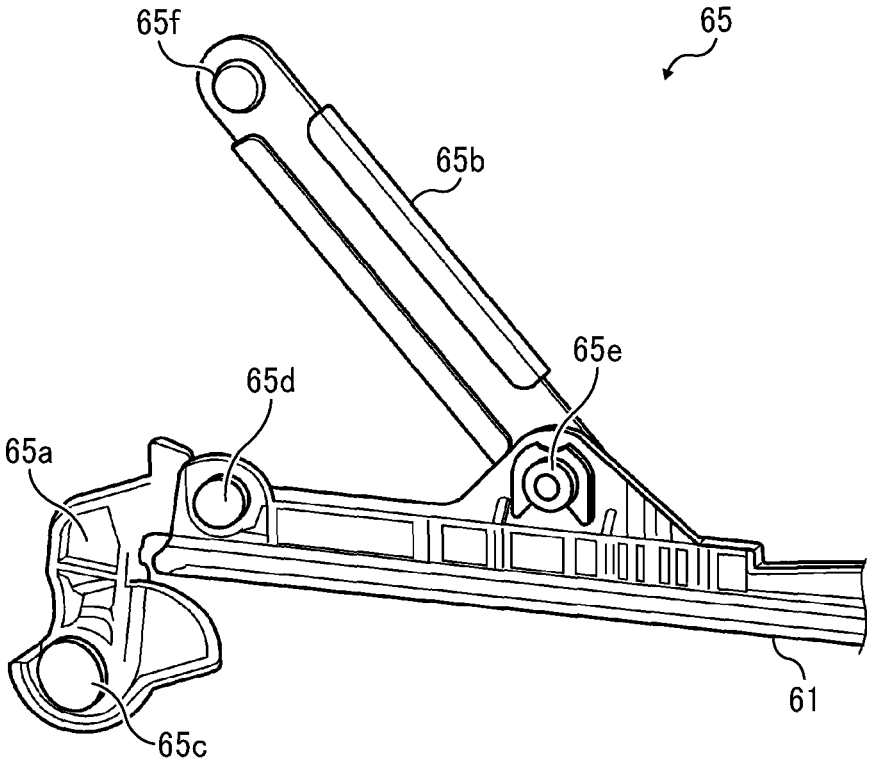
FIG. 4 is a side view illustrating a configuration of a four-bar linkage of the manual sheet feeder according to an embodiment.

FIG. 4 is a diagram illustrating an example configuration of the four-bar linkage 65 to rotate the sheet tray 61.

The four-bar linkage 65 includes a first link 65*a*, a second link 65*b*, a first joint 65*c*, a second joint 65*d*, a third joint 65*e*, and a fourth joint 65*f*. The first link 65*a* is formed in a substantially chevron shape. The second link 65*b* has a linear shape. The first joint 65*c*, the second joint 65*d*, the third joint 65*e*, and the fourth joint 65*f* function as respective fulcrums.

One end of the first link 65*a* is rotatably supported by the first joint 65*c* and is attached to both lateral ends of the sheet tray 61 to an adjacent lower position of the bypass slot 63 of the apparatus body 11. The other end of the first link 65*a* is rotatably supported by the second joint 65*d* and is attached to the end of the sheet tray 61 in the sheet feeding direction.

Further, one end of the second link 65*b* is rotatably supported by the third joint 65*e* and is attached to both lateral ends of the sheet tray 61 at a given position shifted from the first link 65*a* in the opposite direction to the sheet feeding direction of the sheet tray 61. The other end of the second link 65*b* is rotatably supported by the fourth joint 65*f* and is attached to an adjacent upper position of the bypass slot 63 of the apparatus body 11.

Figure 5:
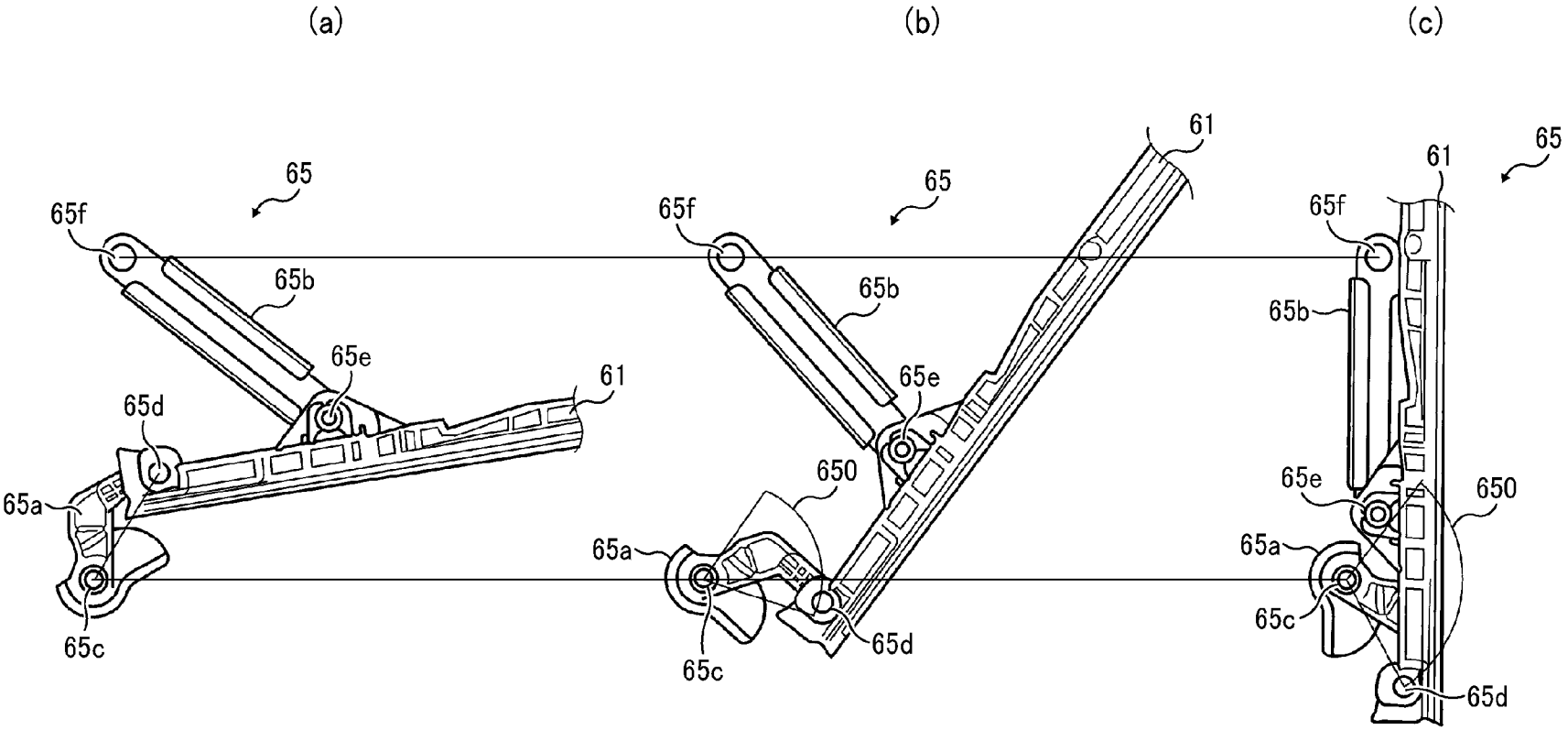
FIG. 5 is a side view illustrating a series of open/close operations in the manual sheet feeder according to an embodiment.

According to the opening/closing operation along with an operation of the bypass sheet feeding, the position of the second joint 65*d* changes along a track 650 illustrated in FIG. 5(*b*) between the sheet feeding position as illustrated in FIG. 5(*a*) and the tray storing position as illustrated in FIG. 5(*c*).

Figure 6:
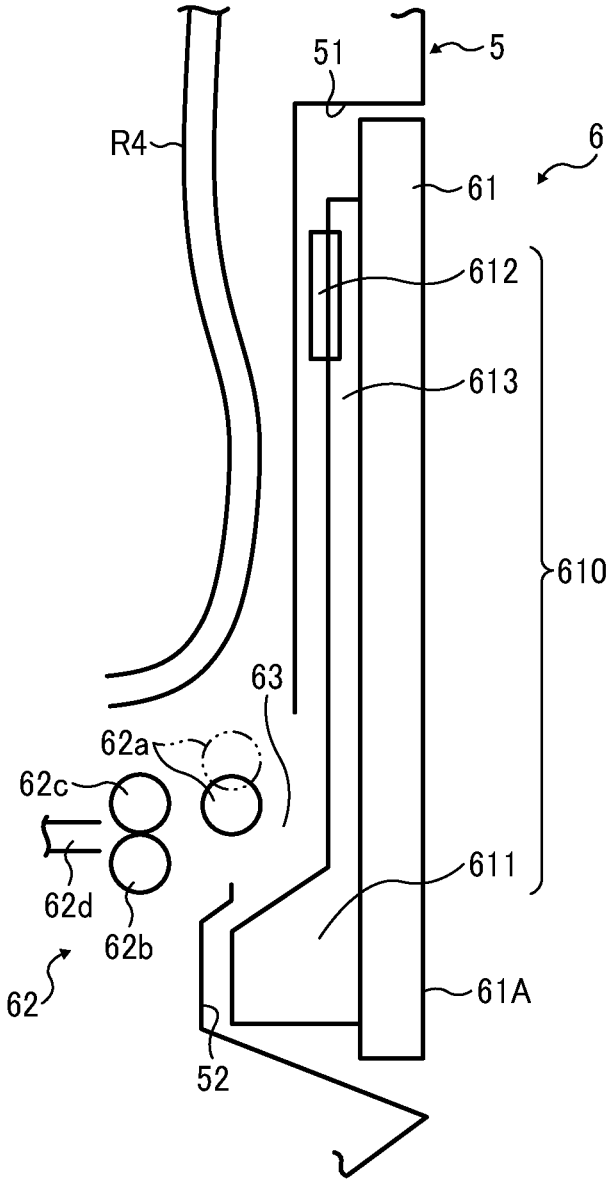
FIG. 6 is a cross-sectional side view illustrating a state in which a sheet tray is stored in the manual sheet feeder.

FIG. 6 is a diagram illustrating that the sheet tray 61 is changed to the tray storing position.

At the tray storing position of the sheet tray 61, the duplex unit 5 has a tray storage 51 provided striding over the bypass slot 63. The tray storage 51 is a recess formed on an exterior of the duplex unit 5 to store the sheet tray 61 such that an outer surface 61A of the sheet tray 61 is placed to be the substantially same surface as the outer surface of the duplex unit 5.

The tray storage 51 has a side fence storage 52 that functions as a guide storage to store at least the guides 611 of the pair of side fences 610. The side fence storage 52 is provided using empty space below the sheet feeding mechanism 62.

When the sheet tray 61 is stored in the tray storage 51, the guides 611 of the pair of side fences 610 are stored in the side fence storage 52 while remaining upright in the first state. By contrast, the guides 612 of the pair of side fences 610 are stored in the tray storage 51 while being bent to be in the second state.

Specifically, in the tray storing position, the side fence storage 52 is formed as a part of the tray storage 51 by using the empty space below the sheet feeding mechanism 62. To store the guides 611 of the pair of side fences 610 in the side fence storage 52, the four-bar linkage 65 is provided to store the sheet tray 61 in the tray storage 51 with the sheet loading surface of the sheet tray 61 located lower than the position connected to the bypass slot 63 that functions as a sheet inserting slot. With this configuration, even when it is difficult to secure space to store the guides 611 and 612 of the pair of side fences 610 due to the conveying path R4 of the duplex unit 5 located above the sheet feeding mechanism 62, the sheet tray 61 can be stored in a manner of space saving by forming the outer surface 61A of the sheet tray 61 to be a substantially same surface as the outer surface of the duplex unit 5 while securing the height of each of the guides 611 of the pair of side fences 610.

Further, the guides 612 of the pair of side fences 610 are foldable at the sheet feeding position to secure a sufficient height.

Figure 7:
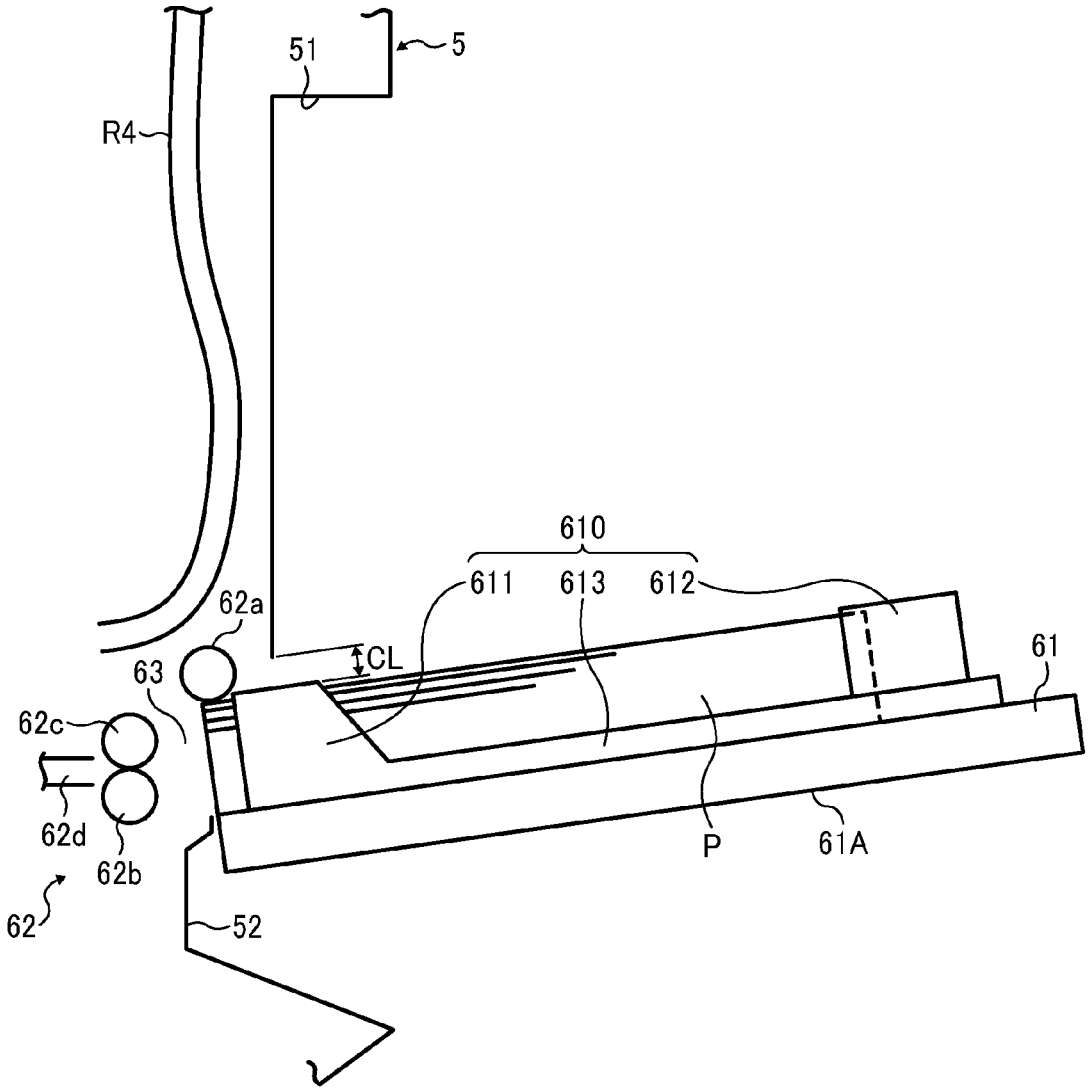
FIG. 7 is a cross-sectional side view illustrating a state in which the sheet tray is feeding a sheet in the manual sheet feeder.
Figure 8:
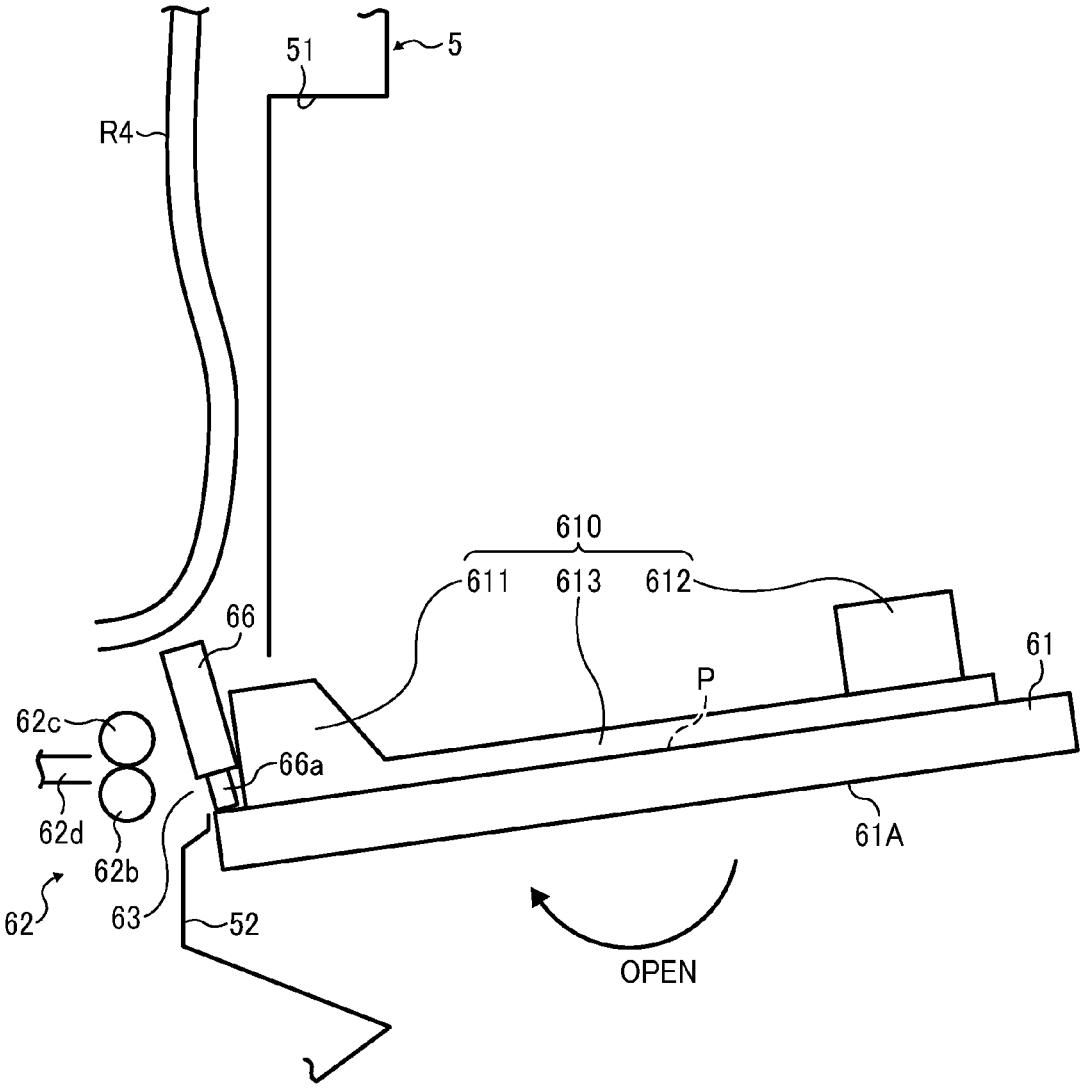
FIG. 8 is a cross-sectional side view illustrating the sheet tray at a sheet feeding position in the manual sheet feeder.

FIGS. 7 and 8 are diagrams illustrating an example that the sheet tray 61 is shifted to the sheet feeding position.

As illustrated in FIG. 7, the movement of the sheet tray 61 by the four-bar linkage 65 is restricted at the sheet feeding position so that the sheet loading surface of the sheet tray 61 is located below the sheet feeding mechanism 62.

Specifically, as illustrated in FIG. 8, when a force absorbing linear damper 66 that functions as a damper mechanism is disposed in the spare space below the sheet feeding mechanism 62, the sheet tray 61 can absorb the force that is exerted to move the sheet tray 61 to the sheet feeding position, and therefore the opening/closing operation can be performed smoothly.

That is, the sheet tray 61 is controlled by the four-bar linkage 65 so that a proximal end in the sheet feeding direction of the sheet loading surface of the sheet tray 61 is located below the bypass slot 63 at the sheet feeding position. Moreover, the proximal end of the sheet loading surface of the sheet tray 61 in the sheet feeding direction contacts the leading end 66*a* of the force absorbing linear damper 66 at the sheet feeding position.

In this case, as the four-bar linkage 65 eventually rotates the sheet tray 61 in the linear direction of the force absorbing linear damper 66, the leading end 66*a* of the force absorbing linear damper 66 is pressed down by the proximal end of the sheet loading surface of the sheet tray 61 in the sheet feeding direction at the sheet feeding position.

Thus, by adjusting the manual sheet feeder 6 such that the proximal end of the sheet loading surface of the sheet tray 61 in the sheet feeding direction is located lower than the bypass slow 63, an optional clearance CL can be provided between an upper part of the guide 611 of the pair of side fences 610 and the bypass slot 63 as illustrated in FIG. 7. By so doing, even when the possible large number of the recording sheets P is loaded on the sheet tray 61, the manual sheet feeder 6 can prevent the sheet feeding operation of the recording sheet P from being interfered by contact of the guide 611 with the bypass slot 63.

The recording sheet P that can be fed by the manual sheet feeder 6 is not limited to PPC (plain paper copier) papers. For example, curled papers and OHP (overhead projector) films can be fed by the manual sheet feeder 6.

The force absorbing linear damper 66 is located using the empty space where no pair of side fences 610 is disposed and corresponding to the proximal end of the sheet loading surface of the sheet tray 61 in the sheet feeding direction. By so doing, the force absorbing linear damper 66 does not affect the manner of space saving of the apparatus body 11.

It is to be noted that a sensor to detect whether the sheet tray 61 is opened or closed and/or a sensor to detect whether the recording sheet P is loaded on the sheet tray 61 or not can be disposed in the manual sheet feeder 6 accordingly.

Figure 9:
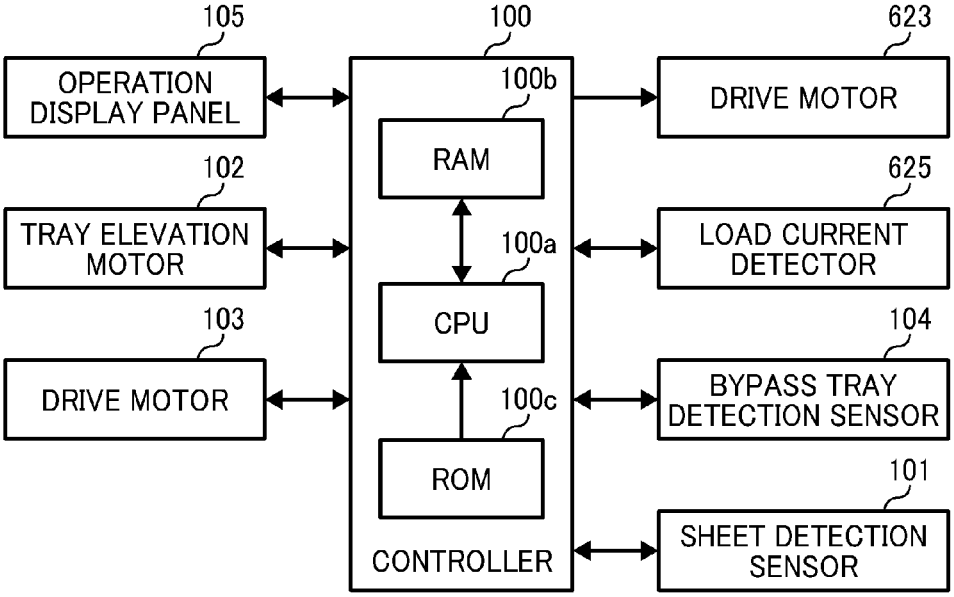
FIG. 9 is a block diagram illustrating a main part of an electric circuit including the manual sheet feeder.

FIG. 9 is a diagram illustrating a schematic configuration of an electric circuit of the image forming apparatus 1 according to the present embodiment.

In FIG. 9, a controller 100 controls driving of various devices and units provided to the image forming apparatus 1. It is to be noted that, while the controller 100 may be connected to various devices and units, the diagram of FIG. 9 shows devices and units related to the manual sheet feeder 6.

The controller 100 includes a CPU 100*a*, a RAM 100*b*, and a ROM 100*c* to control an overall operation of the image forming apparatus 1.

As shown in FIG. 9, the controller 100 is connected to the drive motor 623, the load current detector 625, a sheet detection sensor 101, a tray elevation motor 102, a drive motor 103, a bypass tray detection sensor 104, and an operation display panel 105.

The sheet detection sensor 101 is a detector to detect that the recording sheet P is loaded on the sheet tray 61 of the manual sheet feeder 6.

The tray elevation motor 102 is a motor to ascend/descend and rotate the pickup roller 62*a* of the manual sheet feeder 6 with respect to the sheet tray 61.

The drive motor 103 is a motor to drive the separation/conveyance rollers 62*b* and 62*c*.

The bypass tray detection sensor 104 is a detector to detect whether a bypass mode is set or not, that is, whether he sheet tray 61 of the manual sheet feeder 6 is opened or closed.

The operation display panel 105 issues various signals to instruct, for example, the start of the copying operation and the setting of the bypass mode.

The drive motor 623 is a motor to cause the side fence drive mechanism 620 to move the position of the side fence 610 of the sheet tray 61 according to a size of the recording sheet P.

As previously described, the load current detector 625 is a detector to detect the electric current value that flows to the drive motor 623.

With the above-described configuration, the controller 100 checks input values from the operation display panel 105 and output values to the bypass tray detection sensor 104 so as to determine whether the bypass mode is set or not. That is, when the operation display panel 105 has issued an instruction to set the bypass mode or when the bypass tray detection sensor 104 has detected that the sheet tray 61 of the manual sheet feeder 6 is opened, the controller 100 checks the output values of the sheet detection sensor 101, and determines whether the recording sheet P is loaded on the sheet loading surface of the sheet tray 61.

In this case, in the first state in which the sheet tray 61 of the manual sheet feeder 6 is shifted from the tray storage 51 that is a tray storing position to the sheet feeding position due to operation of the four-bar linkage 65 and the guides 612 of the pair of side fences 610 stands at the sheet feeding position manually or automatically, the controller 100 determines that the recording sheet P is loaded on the sheet loading surface of the sheet tray 61.

Then, the controller 100 waits until a given start time elapses, drives the drive motor 623, the side fence drive mechanism 620 gradually moves the pair of side fences 610 from an initial state in which the fences on both sides are fully separated to a close state in which the fences on both sides approach each other.

Then, on determination that the pair of side fences 610 contacts the recording sheet P based on the output of the load current detector 625, the controller 100 controls the drive motor 623 to stop movement of the pair of side fences 610 at where the pair of side fences 610 contacts the recording sheet P.

In this state, on determination that the start of the copying operation is instructed via the operation display panel 105, the controller 100 starts the bypass feeding operation. Specifically, the controller 100 drives the tray elevation motor 102 to ascend, descend, or rotate the pickup roller 62*a* of the sheet feeding mechanism 62 with respect to the sheet tray 61. Further, the controller 100 causes the drive motor 103 to drive the separation/conveyance rollers 62*b* and 62*c* of the sheet feeding mechanism 62.

With the above-described configuration, the recording sheets P loaded on the sheet tray 61 of the manual sheet feeder 6 are fed one by one to the apparatus body 11 through the bypass slot 63 and conveyed to the conveying path R1 via the guidance path R3. Thus, the copy operation is performed to the recording sheet P fed from the manual sheet feeder 6 at the copying position of the image forming part 3.

At completion of the copying operation, after the recording sheet or sheets P remaining on the sheet tray 61 is or are removed, the positions of the guides 612 of the manual sheet feeder 6 are changed manually or automatically from the first state standing upright at the sheet feeding position to the second state to be bent inwardly toward the center of the sheet tray 61. Then, the sheet tray 61 is moved and rotated by the four-bar linkage 65 to be stored in the tray storage 51 that is a tray storing position.

It is to be noted that movement of the pair of side fences 610 can be controlled based on that the controller 100 determines that the operation display panel 105 has issued the start of the copying operation under a condition that the sheet detection sensor 101 detects the loading of the recording sheet P on the sheet tray 61.

According to the present embodiment, while the height of the side fence 610 in the manual sheet feeder 6 is sufficiently secured, an increase in installation space of the apparatus body 11 due to attaching the manual sheet feeder 6 can be prevented.

Specifically, in the above-described configuration, the guide 612 of the pair of side fences 610 on the sheet tray 61 can be folded inwardly toward the center of the sheet tray 61 and the sheet tray 61 of the manual sheet feeder 6 is rotatably supported by the four-bar linkage 65, so that the sheet tray 61 is moved to the tray storing position while being rotated and moved to the lower part of the bypass slot 63. By so doing, when the sheet tray 61 is stored in the tray storage 51, the guide 612 of the pair of side fences 610 is bent to be in the second state and stored in the tray storage 51 while the guide 611 of the pair of side fences 610 remains upright to be in the first state and is stored in the side fence storage 52 provided lower than the bypass slot 63. With this configuration, even when it is difficult to secure the space to store the guides 611 and 612 of the pair of side fences 610, the empty space below the bypass slot 63 can be used effectively. As a result, while the sufficient height of the pair of side fences 610 is secured, the outer surface 61A of the sheet tray 61 is stored to be the substantially same surface as the outer surface of the duplex unit 5 in a manner of space saving, thereby becoming useful for downsizing and resource-saving.

Further, since the height of the pair of side fences 610 can be secured sufficiently, the general storability and operability as the manual sheet feeder 6 can be secured without degrading the functionality of skew prevention.

It is to be noted that the above-described embodiment describes the guide 612 of the pair of side fences 610 to be switched from the first state in which the guide 612 stands upright at the sheet feeding position to the second state in which the guide 612 is bent at the tray storing position. However, the guide 612 is not limited thereto.

Figure 10:
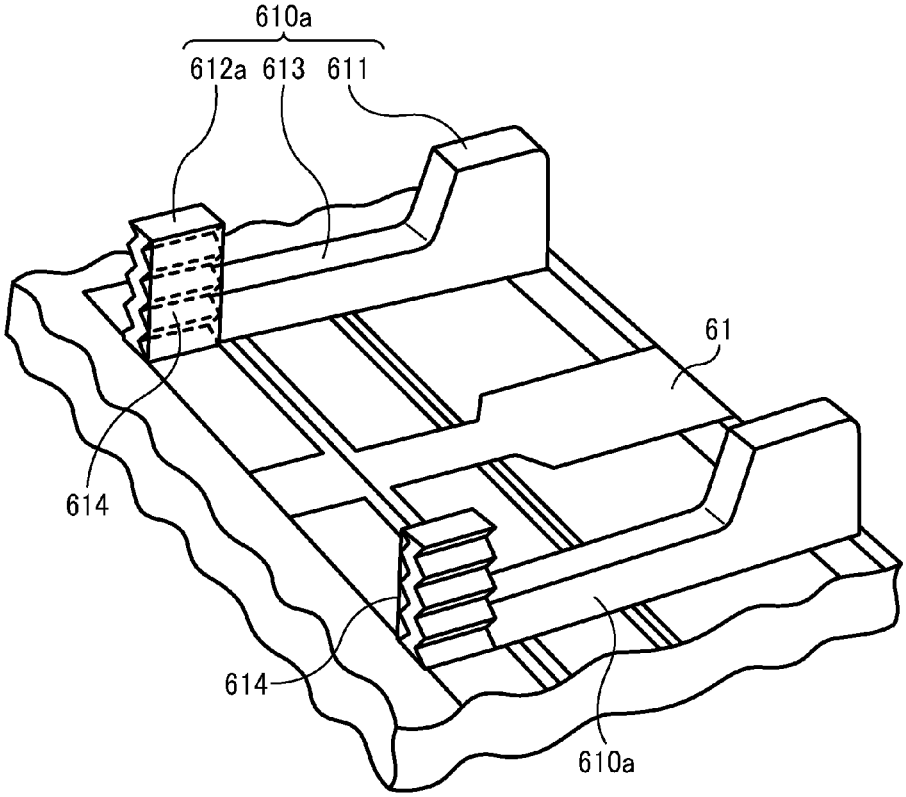
FIG. 10 is a perspective view illustrating a modification of the side fence of the manual sheet feeder.

For example, as a modified configuration illustrated in FIGS. 10 and 11, the manual sheet feeder 6 can include a guide 612*a* having a bellow structure and including an embedded compression spring at the other end of a pair of side fences 610*a*.

Figure 11B:
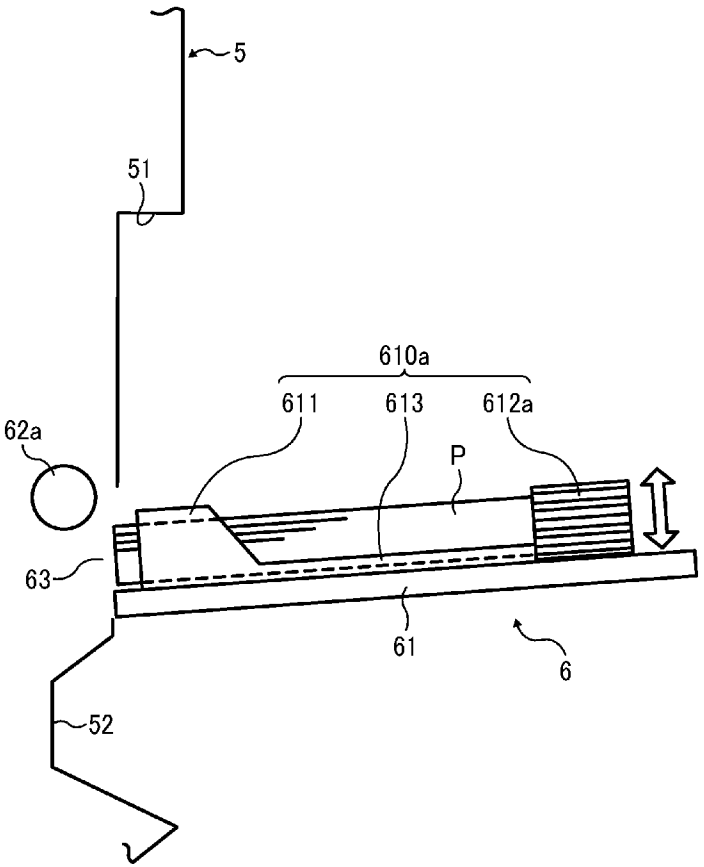
FIGS. 11A and 11B illustrate a modification of the side fence of the manual sheet feeder.
Figure 11A:
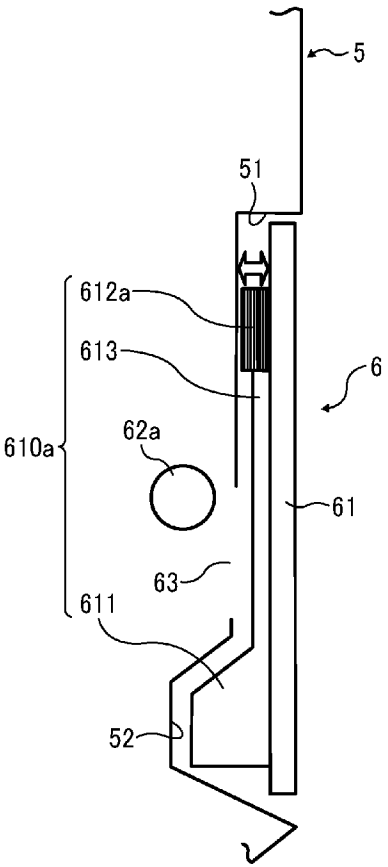

That is, the guide 612*a* may be in the second state in which the guide 612*a* is compressed by contacting the inner wall of the tray storage 51 at the tray storing position as illustrated in FIG. 11A and may be in the first state in which the guide 612*a* is extended due to a restoring force of the embedded compression spring at the sheet feeding position as illustrated in FIG. 11B.

Each of the guides 612*a* having a bellow structure has a film 614 on an inner surface thereof. By providing the configuration in which the leading edge in the width direction of the recording sheet P contacts the film 614 at the sheet feeding position, the pair of side fences 610*a* can restrict the position in the width direction of the recording sheet P, which is the same as the above-described embodiment.

Further, the configuration of the present embodiment has been described to be applied to an image forming apparatus such as a copier including a manual sheet feeder but the configuration is not limited thereto. For example, the configuration of the present embodiment can be applied to any other image forming apparatus such as a facsimile machine and a printer.

As described above, the sheet feeder and the image forming apparatus incorporating the sheet feeder can sufficiently secure the height of the regulating member to regulate the position of the recording medium loaded on the sheet tray and easily achieve space saving.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet feeder comprising:

a sheet tray on which a recording medium is loaded;

a regulating member disposed on the sheet tray and movable in a direction normal to a sheet feeding direction to regulate a position of the recording medium loaded on the sheet tray, the regulating member having guide portions having a height higher than a maximum possible thickness of a sheet stack loadable on the sheet tray and the height thereof is changeable;

a link mechanism to rotatably support the sheet tray to a tray storing position and a sheet feeding position; and a guide storage to store the guide portions of the regulating member as the link mechanism moves the sheet tray from the sheet feeding position to the tray storing position, the guide storage has a depth set to be greater than a length in a height direction of the guide portions, wherein the guide portions of the regulating member include a first guide portion and a second guide portion, the first guide portion is provided on the regulating member at a position corresponding to one end of the regulating member and the second guide portion is provided on the regulating member at a position corresponding to an opposite end of the regulating member in the sheet feeding direction of the recording medium, and wherein the second guide portion is movable in a direction perpendicular to a tray surface, and wherein the second guide portion includes a bellows.

2. The sheet feeder according to claim 1, further comprising a sheet feeding mechanism to separate and feed the recording medium placed on the sheet tray one by one at the sheet feeding position, wherein the guide storage is disposed below the sheet feeding mechanism.

3. The sheet feeder according to claim 2, wherein, when the sheet tray is moved by the link mechanism to the sheet feeding position, a height of a recording medium placed on a sheet loading surface is controlled to be lower than the sheet feeding mechanism.

4. The sheet feeder according to claim 3, further comprising a damper mechanism to regulate a height of the sheet loading surface at the sheet feeding position of the sheet tray.

5. The sheet feeder according to claim 1, wherein the first guide portion is stored in the guide storage.

6. The sheet feeder according to claim 5, wherein the first guide portion is stored in the guide storage in a first state in which the regulating member is substantially vertically standing.

7. The sheet feeder according to claim 5, wherein the second guide portion is switchable between a first state and a second state in which the regulating member is substantially horizontally tilted, wherein, when the sheet tray is moved by the link mechanism to the sheet feeding position, the second guide portion is switched from the second state to the first state, wherein, when the sheet tray is moved by the link mechanism to the tray storing position, the second guide portion is switched from the first state to the second state.

8. The sheet feeder according to claim 1, wherein the link mechanism is a four-bar linkage to move the sheet tray between the tray storing position and the sheet feeding position while the sheet tray is rotating.

9. An image forming apparatus comprising the sheet feeder according to claim 1.

10. The image forming apparatus according to claim 9, wherein the sheet feeder is a manual sheet feeder.

11. The sheet feeder according to claim 1, wherein the first guide portion and the second guide portion are disposed at an upward side and a downward side in a sheet conveyance direction.

* * * * *